US006289548B2

(12) United States Patent
Capoccia

(10) Patent No.: US 6,289,548 B2
(45) Date of Patent: Sep. 18, 2001

(54) SYNTHETIC TORN PATTERNED ROLLER AND ITS METHOD OF PRODUCTION

(76) Inventor: John S. Capoccia, 6124 Cheshire Rd., Galena, OH (US) 43021

( * ) Notice: Subject to any disclaimer, the term of this patent is extended or adjusted under 35 U.S.C. 154(b) by 0 days.

(21) Appl. No.: 09/803,463

(22) Filed: Mar. 9, 2001

Related U.S. Application Data

(63) Continuation of application No. 09/344,479, filed on Jun. 25, 1999.

(51) Int. Cl.[7] ..... B05C 1/08; B05C 17/02

(52) U.S. Cl. ..... 15/244.1; 15/230.11; 15/244.4; 492/28

(58) Field of Search ..... 15/230.11, 244.1, 15/244.4; 492/28, 13, 19

(56) References Cited

U.S. PATENT DOCUMENTS 2,467,010 * 4/1949 Coley .
2,805,436 * 9/1957 Christensen .
3,448,479 * 6/1969 Cademartori .
4,982,472 * 1/1991 Lustofin .
5,693,141 * 12/1997 Tramont .
5,858,092 * 1/1999 Tramont .
6,173,472 * 1/2001 McLaughlin .

* cited by examiner

*Primary Examiner*—Randall E. Chin
(74) *Attorney, Agent, or Firm*—Mueller and Smith, LPA

(57) ABSTRACT

A patterned synthetic sponge mimics a natural sea sponge when creating faux paint finishes. Such synthetic sponge is formed from an open cell elastomeric material that bears a pattern that has been created by a rotating grinding wheel that removes sponge material with a tearing action. A rotating silicon carbide, or other abrasive grit, grinding wheel preferably is used to remove the elastomeric sponge material, which preferably is made from an open cell, inter alia, polyurethane, polyether, polyester foamed elastomer. A paint roller made from the novel patterned synthetic sponge has its edges beveled.

7 Claims, 4 Drawing Sheets

FIG. 4
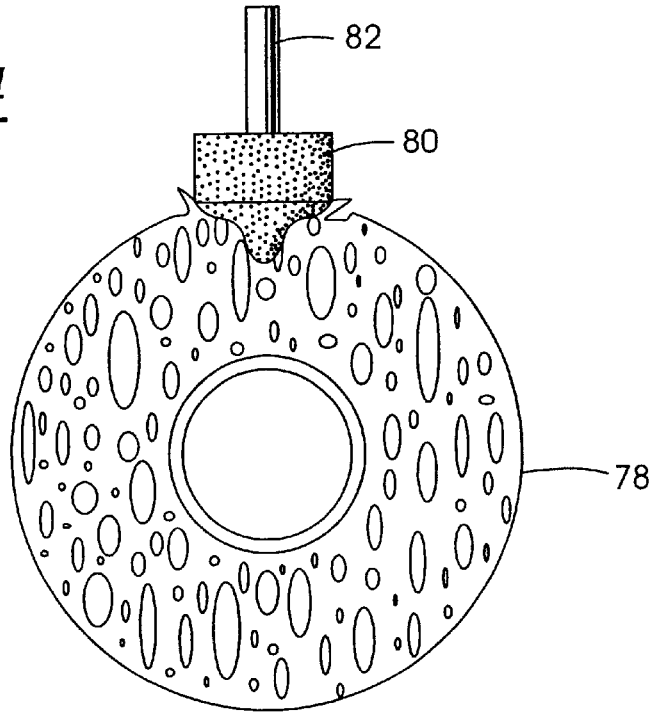
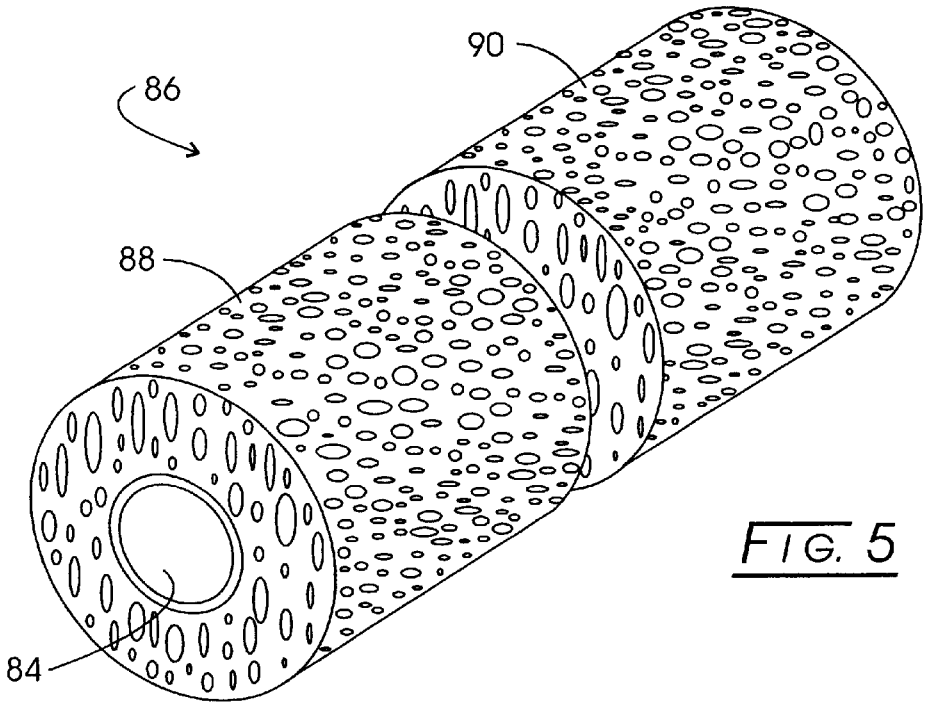
FIG. 5

SYNTHETIC TORN PATTERNED ROLLER AND ITS METHOD OF PRODUCTION

This application is a continuation of Ser. No. 09/344,479 filed Jun. 25, 1999.

CROSS-REFERENCE TO RELATED APPLICATIONS

None.

STATEMENT REGARDING FEDERALLY SPONSORED RESEARCH

Not applicable.

BACKGROUND OF THE INVENTION

The present invention generally relates to tools used in the creation of faux paint finishes and more particularly to a patterned synthetic sponge that mimics natural sea sponge in the creation of faux paint finishes.

Broken pattern surface-coatings were popular in the 1930's. They were produced by techniques known as "ragging on" and "sponging" and which involved a rag or sponge that was used to disturb a freshly painted wall to produce a broken pattern. Considerable skill was required to produce an aesthetically pleasing affect.

Today, such specialty finishes can involve more than one color of paint in order to create a look that otherwise is only available from expensive wall coverings. One such technique involves the application of a base coat of one paint and the selective application of a different color top coat that can be applied by rag or sponge rolling. Alternatively, a top coat can be applied over a dried base coat and some of the top coat removed with a rag, sponge, cheese cloth, or other tool to create the specialty finish desired. U.S. Pat. Nos. 4,930,179 and 5,206,979 are examples thereof. In fact, it even has been proposed to use a bifurcated roller to apply two different colors at the same time in U.S. Pat. No. 5,713,095. A rag wrapped around a tube is another tool proposed in U.S. Pat. No. 5,471,703.

In reality, many of these tools were designed to take the place of scarce and expensive natural sea sponges that provide the most pleasing specialty faux finishes. Despite these designs, however, there still is a need to create a synthetic sponge that would mimic a natural sea sponge in its ability to create faux paint finishes.

BRIEF SUMMARY OF THE INVENTION

A patterned synthetic sponge mimics a natural sea sponge when creating faux paint finishes. Such synthetic sponge is formed from an open cell elastomeric material that bears a pattern that has been created by a rotating grinding wheel that removes sponge material with a tearing/teasing action. A rotating silicon carbide, or other abrasive grit, grinding wheel preferably is used to remove the elastomeric sponge material, which preferably is made from an open cell, inter alia, polyurethane, polyether, polyester foamed elastomer. A paint roller made from the novel patterned synthetic sponge has its edges beveled.

An array of, for example, servo controlled Carborundum® silicon carbide grinding wheels can be used to create patterns in the synthetic sponge which patterns are stored in a computer that also controls the manufacturing process. When the patterned synthetic sponges are in roller form, they can be used to create unique faux paint finishes that heretofore could only be created using natural sea sponges.

Advantages of the present invention include the ability to create roller that mimic natural sea sponges in their ability to create faux paint finishes. Another advantage is that the inventive patterned sponges can be mass-produced economically. These and other advantages will be readily apparent to those skilled in the art based on the present disclosure.

BRIEF DESCRIPTION OF THE DRAWINGS

For a fuller understanding of the nature and objects of the present invention, reference should be made to the following detailed description taken in conjunction with the accompanying drawings, in which like reference numerals refer to like elements throughout, and in which:

FIG. 4 is a cross-sectional view of one grinding wheel engaged into one smooth surface paint roller being torn in FIG. 3;

FIG. 5 is a perspective view of the paint roller of FIG. 1 that has its center removed to create a pair of smaller paint rollers on a single central tube;

Figure 1:
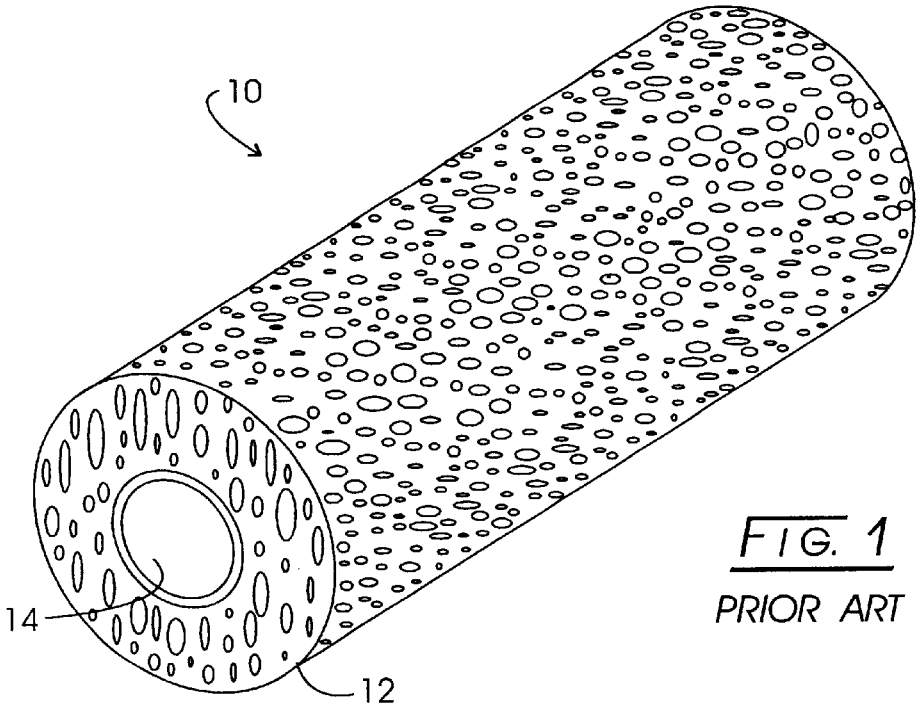
FIG. 1 PRIOR ART
FIG. 1 is a perspective view of a prior art roller.

The drawings will be described in detail below.

DETAILED DESCRIPTION OF THE INVENTION

The key to mimicking natural sea sponges is not to orderly remove the material by a cutting action that would create smooth edges; but rather, to remove material by a tearing action to create ragged edges. Such ragged edges created by a tearing action yield a natural sponge-like affect when used in creating faux or rag paint finishes. In order to obtain such a tearing action, the manufacturer should avoid using sharp edged rotating cutting elements such as router bits. Rather, the manufacturer should use a simple grinding wheel that grabs the synthetic sponge material and thereby tears it. That is not to say that some "cutting" of the material does not happen, as it does. However, many of the edges are torn away by the grinding wheel.

When the synthetic sponge material is composed of an open cell elastomeric material, the torn edges of the open cells are quite similar in structure to natural sea sponges. Thus, the desired affect can be achieved in decorating finishes, such as faux paint finishes, using the novel patterned synthetic sponge. In this regard, the shape or type of pattern is not critical since it is the creation of torn edges that is desired. For present purposes, then, the pattern can be random or predefined, as the creation of torn edges of the open cell foam elastomer is the effect desired.

Three additional problems prevalent with prior art patterned rollers are paint loadup in the patterns, slippage of the roller, and tracking. The first problem is attributed to conventional rollers only having about a 0.25 inch deep pattern and often this is molded into a closed cell foam elastomer. This problem is intentionally solved by using patterns that typically range in depth from about 0.5 to 0.75 or more inches in depth. Such extra deep patterns avoid the pattern grooves from becoming full of paint or loading up which phenomenon results in an ineffective pattern at best being transferred to the wall surface.

The second addressed problem is familiar to all those who paint with rollers and inadvertently roll too much paint on the wall. Instead of the paint roller rolling, it slips on the too heavily paint laden wall. Intentionally, this problem is solved by using an "open cell" foam that essentially "grips" the painted wall surface by dint of the myriad of open cells that act like tiny suction cups. The novel rollers disclosed herein "grip" the painted wall surface much like a radial tire grips the road surface (compared to a biased tire).

The third addressed problem involves the edges of the paint roller leaving a "track" or ridge of paint that must be smoothed over with each adjacent are being painted. When transferring a pattern to a painted wall, the painter cannot overlap each adjacent rolled area at the risk of destroying part of the pattern already laid down. To intentionally solve this problem, the inventive rollers have their edges beveled. Such edge beveling permits the applicator to place each adjacent pattern directly in abutting juxtaposition with each adjacent pattern without overlapping the prior pattern.

It will be observed, then, that the uniqueness of the inventive torn-patterned sponge rollers have properties that can be translated to other foam rollers that are not sponge-like in nature. For such conventional paint rollers made from typically less elastomeric foams, the pattern will be cut with smooth edges with, for example, a router type bit; however, such patterns will be deeper (0.5"–0.75"), will be made from an open cell foam, and will have their edges beveled. In this regard, such features also can be used to advantage with stippling rollers that transfer patterns to topping or stippling compound (see, for example, U.S. Pat. Nos. 5,378,419, 5,414,434, and 5,580,608 for more information on topping or stippling compounds and patterns formed therein).

Referring now to FIG. 1, conventionally configured elongated paint roller 10 is seen in perspective view formed from annular elastomer 12 that surmounts inner annular tube 14. This is a conventional paint roller used by both professional and homeowners to paint interior walls. Heretofore, such paint rollers were made from closed cell elastomeric foamed materials. The invention teaches that an open cell foam elastomer can provide unexpected advantages by relying on the ability of the exposed open cells on the outer surface of roller 10 to better grip the wet paint on the wall and, thus, prevent the tendency of the roller to slip. Such slippage is even more detrimental when rolling a pattern into topping compound, a so-called stippling operation. Nevertheless, one preferred configuration of the novel torn patterned open cell synthetic sponge is in such elongate paint roller configuration. There are, however, a variety of other useful configurations for the novel torn patterned open cell synthetic sponge as those skilled in the art will appreciate based on the instant disclosure.

Figure 2:
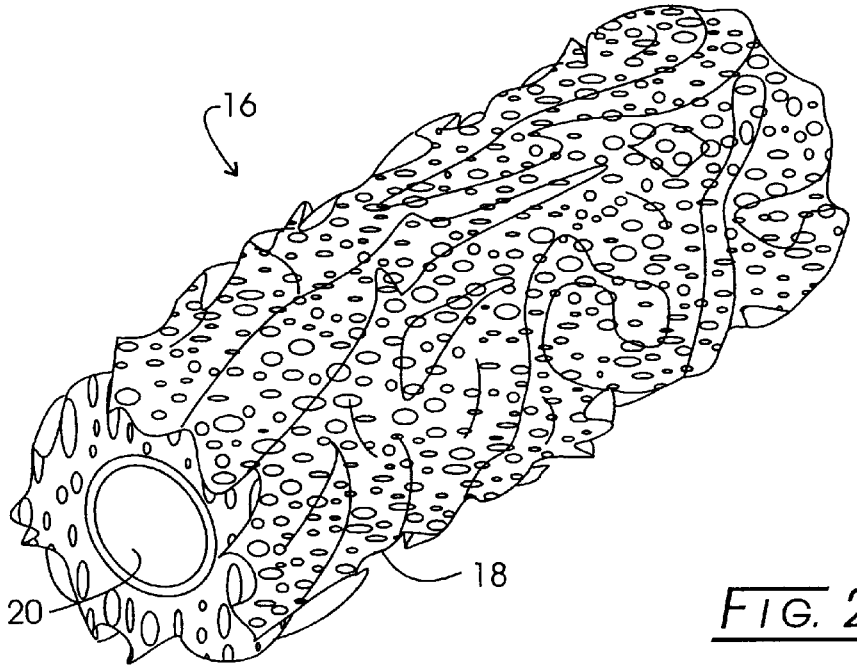
FIG. 2 is a perspective view of the novel patterned torn or ragged open cell sponge in a conventional paint roller configuration.

Referring now to FIG. 2, depicted is novel torn patterned open cell synthetic sponge roller head 16 which is formed from outer annular torn patterned open cell sponge elastomer 18 which surmounts and is bonded to inner annular core 20. Core 20 is designed to have a conventional paint roller wire core inserted thereinto, such core being rotatably affixed to a handle. Novel torn patterned open cell synthetic sponge roller 16 when affixed to such roller and handle then can be rolled into a thin layer of paint in a shallow pan and then brought into contact with the wall to be painted. The rolling action of the roller then transfers the paint from novel torn patterned open cell synthetic sponge roller 16 onto the wall in conventional fashion. The same operation would be practiced when transferring a pattern to topping compound, however the roller head would be dry and would transfer its pattern into the topping compound.

Nevertheless, novel torn patterned open cell synthetic sponge roller head 16 is characterized by the method by which the pattern was formed. That is, elastomeric material was removed from novel torn patterned open cell synthetic sponge roller head 16 by a tearing action rather than being cut. Thus, the manufactured should use a head to remove the elastomeric material that does not have sharp edges and will not effect a cutting action. Rather, it has been unexpectedly discovered that the elastomeric material should be removed by a tearing action to leave torn or ragged edges where the elastomeric material has been removed. In this regard, it should be understood that the pattern formed is unimportant in so far as the novel features of torn patterned open cell synthetic sponge roller head 16 are concerned. While any suitable pattern can be formed, so long as it is formed by a suitable tearing action in open cell synthetic sponge elastomeric material, the novel affects of torn patterned open cell synthetic sponge roller head 16 will be achieved. That is not to say that certain patterns may not be more aesthetically pleasing as this certainly is true; however, the present invention is not limited to any particular pattern.

Torn patterned open cell synthetic sponge roller head 16 may even contain loosely-connected thin strands of elastomeric material as a result of the tearing action used in the manufacturing process. Indeed, the edges of the pattern will be quite ragged, uneven, and disheveled in appearance. Such appearance might even put off some users from believing that torn patterned open cell synthetic sponge roller head 16 could even be used to create unique and delicate paint patterns when creating faux painted walls. Such looks, however, are deceiving as will be amply demonstrated by simply using torn patterned open cell synthetic sponge roller head 16 only once.

Creation of the torn pattern may even be accomplished by grasping the elastomeric material between the fingers and ripping out the grasping material. However, it does take a good deal of strength to tear such elastomeric material and such hand operation is not conducive to large scale manufacturing operations. Rather, the manufacturer must seek a method by which such hand tearing action can be achieved mechanically. An apparatus for implementing such action is depicted in simplified form in FIG. 3. In order to tear three-dimensional patterns into the open cell sponge material, apparatus 22 must accommodate x-axis, y-axis, and z-axis movement of its tearing head as its point of contact with the open cell sponge material. This is accomplished by use of drive unit 24 to move carriage assembly 26 down side rails 28, 30, in order to achieve y-axis movement as indicated by arrow 32. Conveniently, drive unit 24 can be an electrical motor having a pinion gear mounted to a shaft that engages the rack formed on the inside of rail 28 to form a rack and pinion drive. Alternatively, drive unit 24 could be hydraulically or pneumatically actuated, for example. For that matter, belts and pulleys, or other drive systems also could be used. The particular drive means used is a matter of choice by the manufacturer and is not a limitation of the present invention.

Next, z-axis movement of grinding heads 34 and 36 is achieved by plunge drive units 38, 40, respectively,. Again, electric, pneumatic, hydraulic, or other motive means can be used to power plunge drive units 38, 40 that control the depth of the pattern being formed or z-axis control as indicated by arrow 42. Rotation of grinding heads 34, 36 is achieved by drive units 35, 37, respectively.

X-axis control is uniquely achieved in apparatus 22 by rotating shafts 44, 46 with drive units 48, 50, respectively.

Again, drive units 48, 50 may be electric, pneumatic, hydraulic, or other motive means. Rotation of shafts 44, 46, causes sponge blanks 52, 54, 56, and 60 to similarly rotate and achieve an effective x-axis movement as indicated by arrows 62 and 64. It will be appreciated that additional structural support will be provided to apparatus 22 in order to support rails 28, 30; shafts 44, 46; all drive units; etc. Such support structure is to be provided in conventional fashion.

In order to impart a pattern into open cell sponge blanks 52, 54, 56, and 58, all drive units need to be controlled and their operation coordinated. Thus, all drive units are connected to controller 66 as follows: drive unit 24 by line 68; drive unit 38 by line 70; drive unit 40 by line 72; drive unit 48 by line 74; and drive unit 50 by line 76. A conventional CNC can conveniently be used to advantage with desirable patterns stored in memory in controller 66. With today's computer controlled systems, the same pattern can be torn into sponge blanks 52, 54, 56, 58, or even different patterns can be torn into the sponge blanks. In this regard it should be understood that the number of shafts and roller blanks depicted in FIG. 3 are for illustrative purposes only and that a greater or lesser number of them could be provided in accordance with the precepts of the present invention.

Figure 3:
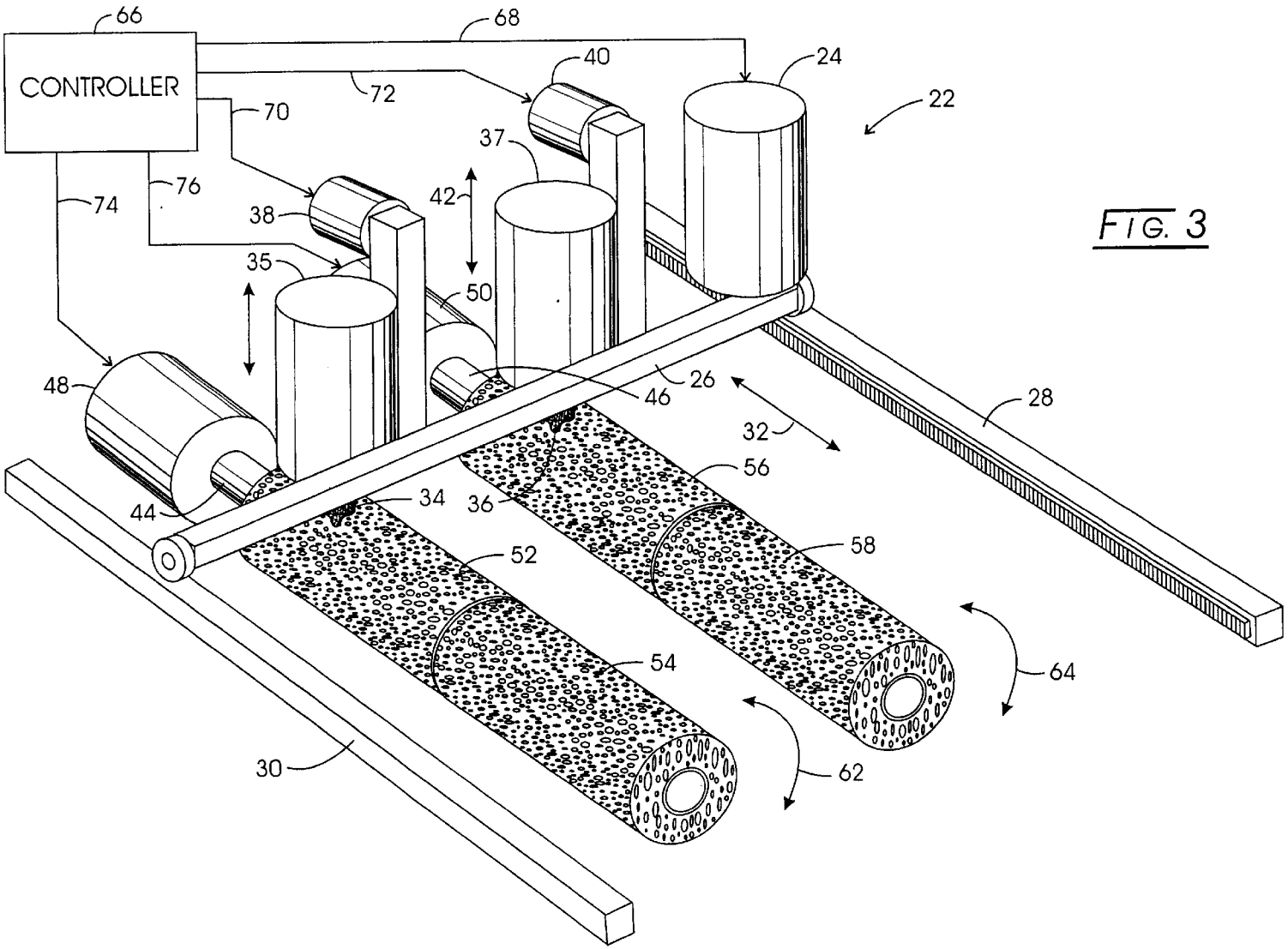
FIG. 3 is a simplified perspective view of a computer numerical control (CNC) machine for tearing the pattern into a smooth surface paint roller, like that depicted in FIG. 1, wherein multiple grinding wheels are used to tear multiple rollers in a single operation.

It should be understood also that a variety of machine designs other than that depicted in FIG. 3 could be envisioned for carrying out the present invention. The presently preferred design, however, is that depicted in FIG. 3.

With respect to the actual creation of the torn pattern in sponge blanks 52, 54, 56, 58, grinding heads 34 and 36 conveniently are made from conventional grinding wheels made from, for example, silicon carbide in a bonding matrix and typified by Carborundum® grinding wheels. The grittiness of such grinding wheels creates friction with the sponge material in the blank that results in a tearing of the sponge material for its removal. Referring to FIG. 4, blank 78 is shown in cross-section with grinding wheel 80 affixed to shaft 82 which in turn will be connected to a drive unit, such as, for example, drive unit 35 shown in FIG. 3. It will be observed that grinding wheel 80 has been uniquely shaped to have a cylindrical upper end and a nipple-shaped lower end that primarily engages sponge blank 78. An effective tearing action is achieved by such design.

Referring to FIG. 5, if grinding wheel 34, for example, is plunged down to meet core 84 of blank 86 and blank 86 rotated 360°, two separate blanks 88, 90 will be created. Each blank 88, 90 then can be patterned and used, for example, by dipping each into a different color of paint to create truly unique faux patterns. Use of two abutting paint trays each filled with a different color of paint is but one technique for implementing such dual head faux painting regimen. Such method of manufacture is much simpler than the dual roller shown in U.S. Pat. No. 5,713,095. In this regard, creation of such a dual-head roller as depicted in FIG. 5 (with the groove creating blanks 88, 90 as the pattern) is an advancement in the art for 2-color painting in general.

Figure 6:
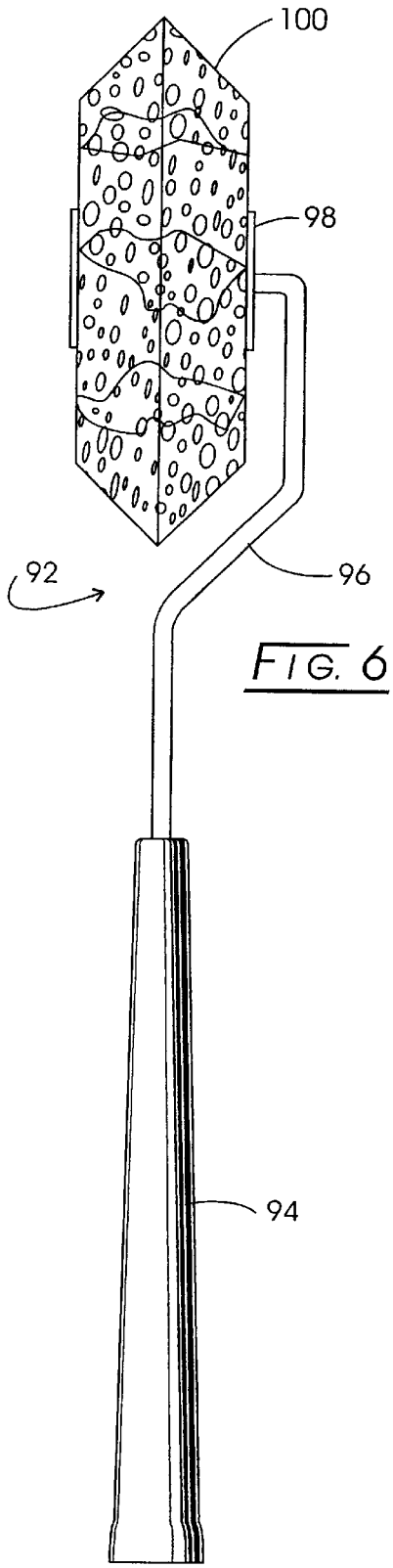
FIG. 6 is a side elevational view of the novel torn patterned open cell synthetic sponge roller configured in a comer roller embodiment.
Figure 7:
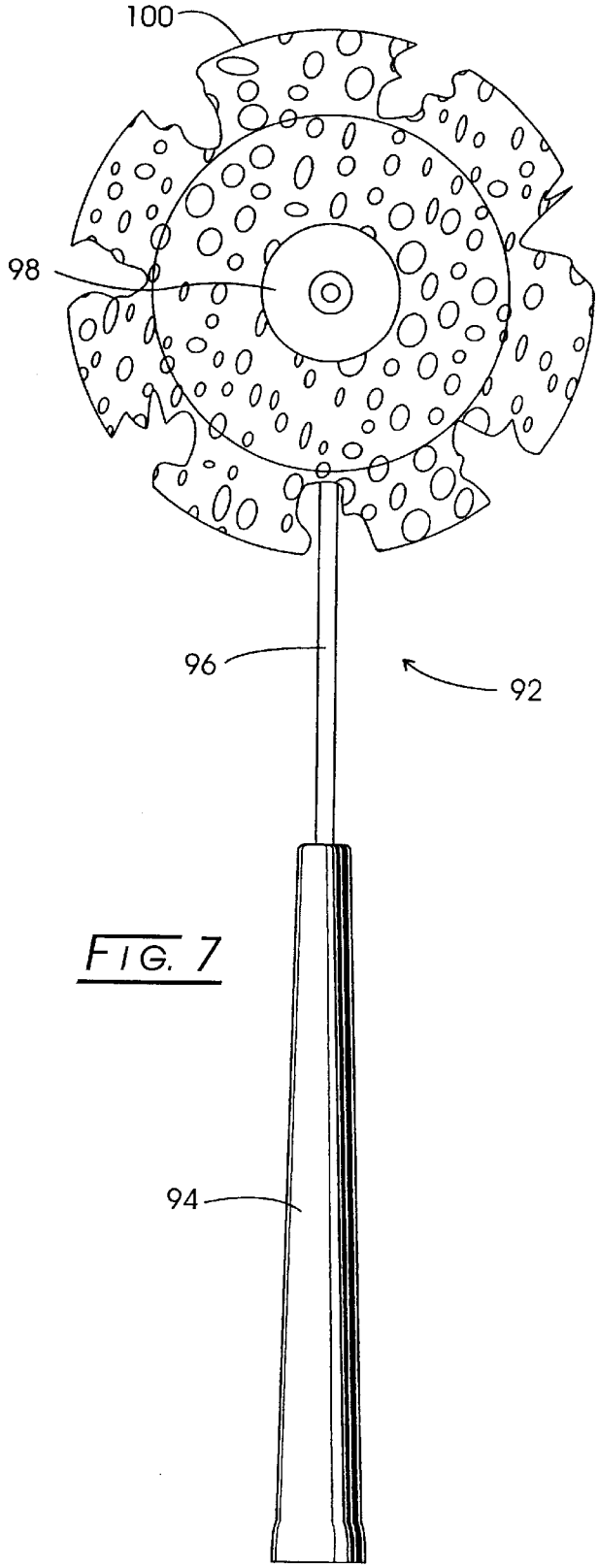
FIG. 7 is a side elevational view of the corner roller embodiment of FIG. 6.

Even with novel torn patterned open cell synthetic sponge roller head 16, the user is limited in the ability to effectively paint interior corners. Roller head 16 simply is too large to fit into an interior corner. In order to demonstrate the flexibility and adaptability of the present invention, reference is made to FIGS. 6 and 7 wherein corner open cell synthetic sponge roller 92 is depicted in side elevational view and in front elevational view, respectively. It will be observed that corner roller 92 is formed from handle 94 that is connected to the distal end of bent elongate wire 96. The proximal end of wire 96 bears roller core 98 that is adapted to receive corner open cell synthetic sponge roller head 100. Corner roller head 100 is made from open cell elastomeric sponge material that has been beveled at both ends to form a point about its central axis. The angle thus-formed desirably is about 90° to mate with an interior corner. A torn pattern again has been formed in corner roller head 100 as has been described above. The extreme depth of the pattern clearly can be seen from FIG. 7. The user need only use roller head 16 on the flat wall surfaces and corner roller 92 in the corners to entirely faux paint a room with a pattern that effectively matches. The slight difference in the pattern between corner roller head 100 and roller head 16 will not be discernable to the ordinary observer.

In this regard, the design of the inventive patterned corner roller can be carried over to a variety of other paint rollers even made from closed cell foams; although, the gripping effect of the invention open cell rollers is sacrificed. It will be appreciated that the depth of the pattern created in the inventive patterned rollers, then, can be used to advantage in the creation of rollers for applying a stipple pattern into topping compound. The inventive corner roller would have the same utility.

The synthetic sponge may be formed from polyurethane, polyether, polyester, or like elastomer that is suitable for making a sponge product. Open cell foamed products can be made with suitable blowing agents and by other techniques commercially practiced in a variety of art fields. The degree of elasticity may vary from manufacturer to manufacturer. Indeed, a variety of elasticity's may function effectively for making the inventive torn patterned open cell synthetic sponge roller heads of the present invention. Of course, if use of the torn patterned open cell synthetic sponge roller head is for stippling topping compound, a stiffer foam would be desired than if faux painting was being done. Those skilled in the art will appreciate and be able to select the desired degree of elasticity desired of the torn patterned open cell synthetic sponge roller head depending upon the use being made thereof.

It will be apparent to those skilled in the art that a variety of additional embodiments for the present invention can be envisioned based on the precepts of the present invention disclosed herein. In this application, all citations are expressly incorporated herein by reference.

I claim:

1. A patterned synthetic sponge, which comprises:

a synthetic sponge formed from an open cell elastomeric material and bearing a pattern having ragged, torn edges, being at least about 0.5" in depth, said patterned synthetic sponge simulating a natural sea sponge when creating faux paint finishes therewith.

2. The sponge of claim 1, which is formed as an elongated annulus surmounting an interior annular core, wherein the edges of said sponge are beveled, for forming a paint roller head.

3. The sponge of claim 2, wherein said bevels meet in a point for forming a corner paint roller head.

4. The sponge of claim 2, wherein a pair of spaced-apart sponges surmounts said annular core.

5. The sponge of claim 1, wherein said elastomeric material is selected from polyurethane, polyester, or polyether.

6. The sponge of claim 1, wherein said pattern was created with a rotating grinding wheel that removes sponge material with a tearing action.

7. The sponge of claim 1, wherein the pattern ranges in depth from about 0.5 inches to about 0.75 inches.

* * * * *

US006289548C1

(12) EX PARTE REEXAMINATION CERTIFICATE (6142nd)

United States Patent

Capoccia

(10) Number: US 6,289,548 C1

(45) Certificate Issued: Mar. 4, 2008

(54) SYNTHETIC TORN PATTERNED ROLLER AND ITS METHOD OF PRODUCTION

(76) Inventor: John S. Capoccia, 6124 Cheshire Rd., Galena, OH (US) 43021

Reexamination Request:
No. 90/006,595, Apr. 9, 2003

Reexamination Certificate for:

| | |
|---|---|
| Patent No.: | **6,289,548** |
| Issued: | **Sep. 18, 2001** |
| Appl. No.: | **09/803,463** |
| Filed: | **Mar. 9, 2001** |

Related U.S. Application Data

(63) Continuation of application No. 09/344,479, filed on Jun. 25, 1999, now abandoned.

(51) Int. Cl.
*B05C 17/02* (2006.01)
*B05C 1/08* (2006.01)

(52) U.S. Cl. ..... 15/244.1; 15/230.11; 15/244.4; 492/28; 492/30

(58) Field of Classification Search ..... 15/230.11, 15/210.5, 244.1, 244.4; 492/13, 19, 28, 30
See application file for complete search history.

(56) References Cited

U.S. PATENT DOCUMENTS

| | | | | | |
|---|---|---|---|---|---|
| 2,994,899 | A | * | 8/1961 | Moilanen | 15/230.11 X |
| 4,030,414 | A | * | 6/1977 | McGuire | 15/210.5 X |
| 4,201,801 | A | * | 5/1980 | Hori | 492/30 X |
| 5,713,095 | A | * | 2/1998 | Wakat | 15/230.11 |
| 5,822,826 | A | * | 10/1998 | Parker | 15/244.4 |
| 6,013,132 | A | * | 1/2000 | Tramont | 15/230.11 X |
| 6,330,731 | B1 | * | 12/2001 | Jackson et al. | 15/230.11 |

FOREIGN PATENT DOCUMENTS

| | | | | |
|---|---|---|---|---|
| AU | 1405 | * | 3/1931 | 15/210.5 |
| DE | 351134 | * | 4/1922 | 15/210.5 |
| FR | 2489175 | * | 3/1982 | 15/230.11 |

OTHER PUBLICATIONS

Hemming, *Paint Finishes*, Quarto Publishing Limited, Secaucus, NJ, pp. 58–61 (1985).

David Carter, text by Charles Hemming, *The Complete Book of Paint*, Michael Friedman Publishing Group, Inc., New York, NY, p. 86 (1996).

* cited by examiner

*Primary Examiner*—Mark Spisich

(57) ABSTRACT

A patterned synthetic sponge mimics a natural sea sponge when creating faux paint finishes. Such synthetic sponge is formed from an open cell elastomeric material that bears a pattern that has been created by a rotating grinding wheel that removes sponge material with a tearing action. A rotating silicon carbide, or other abrasive grit, grinding wheel preferably is used to remove the elastomeric sponge material, which preferably is made from an open cell, inter alia, polyurethane, polyether, polyester foamed elastomer. A paint roller made from the novel patterned synthetic sponge has its edges beveled.

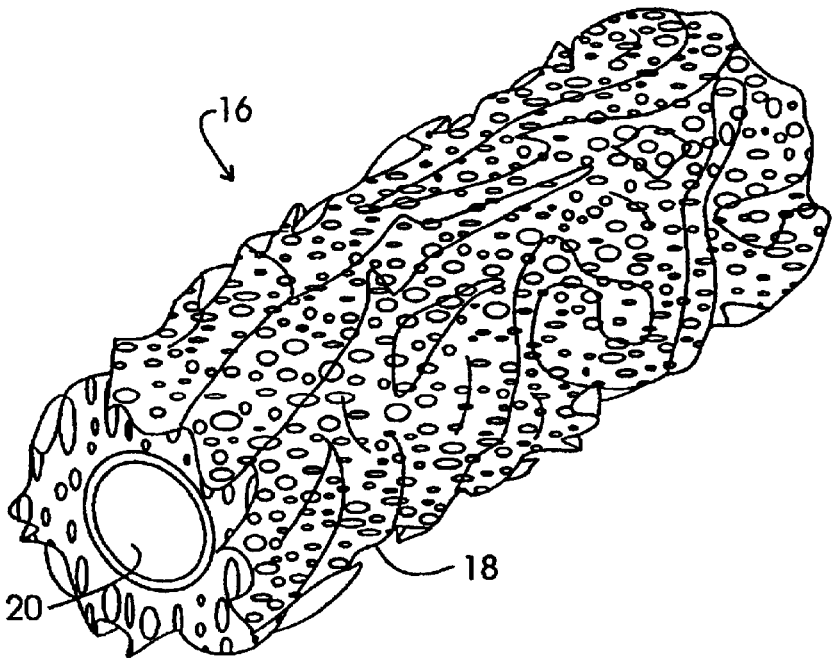

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *